US006604553B1

(12) United States Patent
Speich

(10) Patent No.: US 6,604,553 B1
(45) Date of Patent: Aug. 12, 2003

(54) DEVICE FOR NOISE REDUCTION, AIR-CONDITIONING AND ACCIDENT REDUCTION FOR A JACQUARD WEAVING MACHINE AND JACQUARD WEAVING MACHINE WITH SUCH A DEVICE

(75) Inventor: Francisco Speich, Gipf-Oberfrick (CH)

(73) Assignee: Textilma AG, Hergiswil (CH)

( * ) Notice: Subject to any disclaimer, the term of this patent is extended or adjusted under 35 U.S.C. 154(b) by 0 days.

(21) Appl. No.: 09/869,472

(22) PCT Filed: Nov. 23, 1998

(86) PCT No.: PCT/CH99/00561

§ 371 (c)(1),
(2), (4) Date: Jun. 28, 2001

(87) PCT Pub. No.: WO00/39377

PCT Pub. Date: Jul. 6, 2000

(30) Foreign Application Priority Data

Dec. 28, 1998 (DE) ..... 298 23 116 U

(51) Int. Cl.[7] ..... D03D 41/00
(52) U.S. Cl. ..... 139/1 R; 139/1 C; 139/11
(58) Field of Search ..... 139/1 R, 1 C, 139/11, 59, 116.2

(56) References Cited

U.S. PATENT DOCUMENTS

| | | | | |
|---|---|---|---|---|
| 3,378,998 A | | 4/1968 | Shackelford | |
| 3,391,528 A | * | 7/1968 | Shachkleford | 57/304 |
| 3,627,201 A | | 12/1971 | Partsch | |
| 3,921,675 A | * | 11/1975 | Filter et al. | 139/1 C |
| 4,088,157 A | * | 5/1978 | Chen et al. | 139/1 R |
| 4,265,277 A | * | 5/1981 | Baumann et al. | 139/1 R |
| 4,365,650 A | * | 12/1982 | Dornier et al. | 139/1 R |
| 5,738,150 A | * | 4/1998 | Roelstraete | 139/1 C |
| 6,006,790 A | * | 12/1999 | Cooper | 139/1 C |

FOREIGN PATENT DOCUMENTS

| | | |
|---|---|---|
| DE | 19 21 208 | 11/1969 |
| DE | 28 33 984 | 1/1980 |
| DE | 82 17 236.6 | 11/1982 |
| DE | 32 28 197 | 3/1983 |
| DE | 39 30 307 | 3/1990 |
| DE | WO 95/34701 | 12/1995 |
| EP | 866 158 | 9/1998 |
| FR | 2 314 434 | 1/1977 |
| GB | 2 008 160 | 5/1979 |
| GB | 2 027 878 | 2/1980 |
| GB | 2 059 461 | 4/1981 |

* cited by examiner

*Primary Examiner*—John J. Calvert
*Assistant Examiner*—Robert H. Muromoto, Jr.
(74) *Attorney, Agent, or Firm*—Ostrolenk, Faber, Gerb & Soffen, LLP

(57) ABSTRACT

A plurality of casing modules are mountable to a Jacquard weaving machine such as to enclose same. A first module encloses the weaving machine and comprises a device for supply fresh or conditioned air. A second module encloses the weaving area and harness, and comprises a device for evacuating used air. The arrangement reduces environmental pollution caused by noise, dust or process steam in a weaving shed, considerably improves operator comfort at the weaving machine and significantly decreases accident risk.

18 Claims, 6 Drawing Sheets

3
15
33
39
28
14
14
A
34
68
12
13
35
V
66
V
33
36
64
62
23
60
6
5
11
27
51

FIG. 4
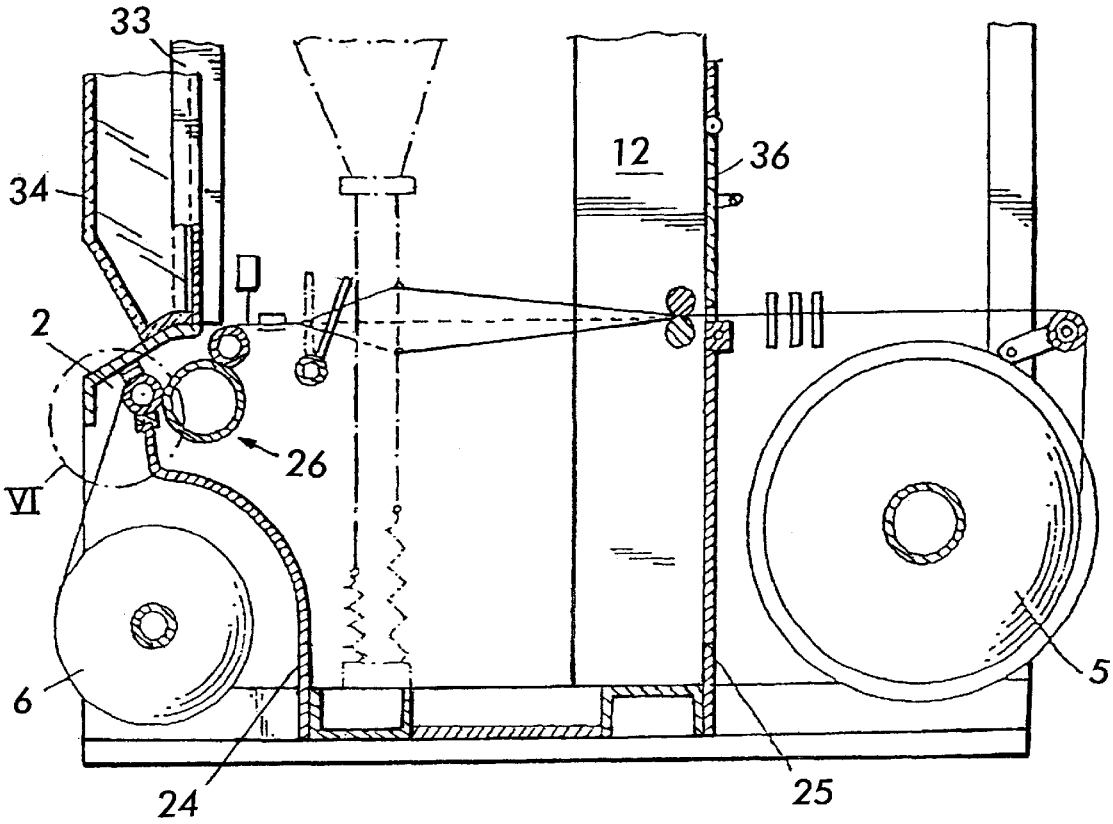
FIG 5
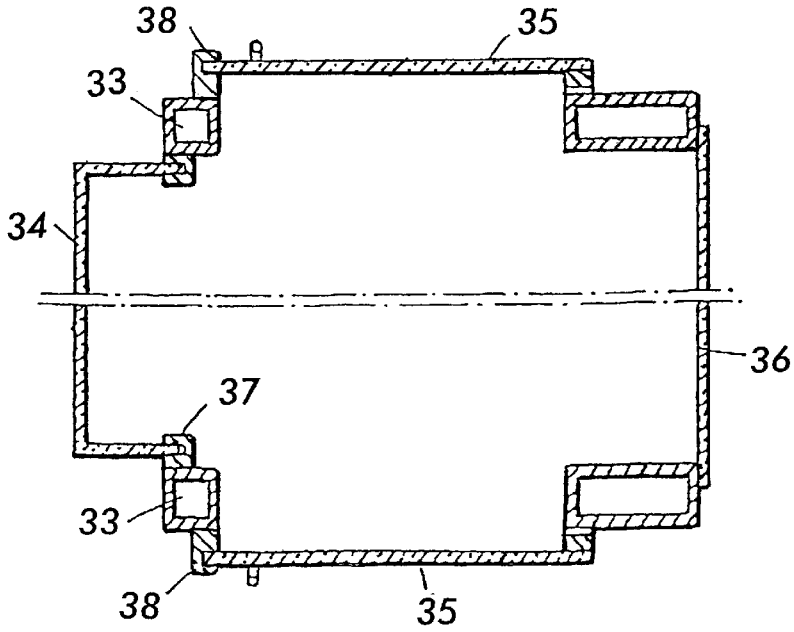
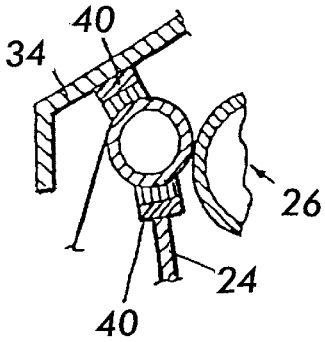
FIG. 6

DEVICE FOR NOISE REDUCTION, AIR-CONDITIONING AND ACCIDENT REDUCTION FOR A JACQUARD WEAVING MACHINE AND JACQUARD WEAVING MACHINE WITH SUCH A DEVICE

PRIORITY CLAIM

This is a U.S. national stage of application No. PCT/CH99/00561, filed on Nov. 23, 1999. Priority is claimed on that application and on the following application:

Country: Germany, Application No.: 298 23 116.6, Filed: Dec. 28, 1998.

BACKGROUND OF THE INVENTION

The invention relates to an arrangement for noise reduction, air-conditioning and accident prevention for a Jacquard weaving machine and to a Jacquard weaving machine with the arrangement.

It is known to provide weaving machines with covers and subject them to conditioned air in order to achieve noise reduction and provide a constant environment for the warp. A weaving machine has become known, in which the driving region and the weaving region are enclosed by means of covers. The disadvantages of this weaving machine are that it is designed in two parts and is unsuitable as a Jacquard weaving machine.

SUMMARY OF THE INVENTION

The object on which the invention is based is to provide an arrangement for noise reduction, air-conditioning and accident prevention for a Jacquard weaving machine, which can be used on a weaving machine without substantial changes.

The object is achieved, according to the invention, by the provision of a plurality of subassemblies which can be mounted on the Jacquard weaving machine to encase said machine. A first casing defining subassembly which encases the weaving machine has means for introducing conditioned air. A second casing defining subassembly encases the weaving region and the harness, and has means for extracting air by suction.

The advantages which can be achieved by means of the invention are to be seen essentially in that, due to the reduction in machine noise, the working conditions for the personnel are improved, in that, by the warp being subjected to conditioned air, the weaving performance and the weaving quality are improved, in that, by the suction extraction of the air contaminated by dust or sometimes toxic process vapours and by sources of danger being shielded, the working conditions for the personnel are improved, and in that the retrofitting of existing weaving machines is possible.

The invention also provides that a Jacquard weaving machine with a gripper weaving machine or jet-weaving machine, with a Jacquard machine and a stand for the machine, is provided with a first subassembly which encases the weaving machine and has means for introducing conditioned air, this subassembly being mounted on a weaving machine stand. A second subassembly which encases the weaving region and the harness, and which has means for extracting air by suction, is mounted on a stand of the Jacquard machine.

The advantage of this machine is that environmental pollution due to noise and dust and process vapours in a weaving shed and the risk of accidents at the weaving machine are reduced.

BRIEF DESCRIPTION OF THE DRAWINGS

The invention is explained below with reference to the accompanying drawings in which:

FIG. 4 shows a section along the line IV—IV in FIG. 3;

FIG. 5 shows a section along the line V—V in FIG. 2 without the weaving machine;

FIG. 6 shows a detail VI in FIG. 4;

DESCRIPTION OF THE PRESENTLY PREFERRED EMBODIMENTS

Figure 1:
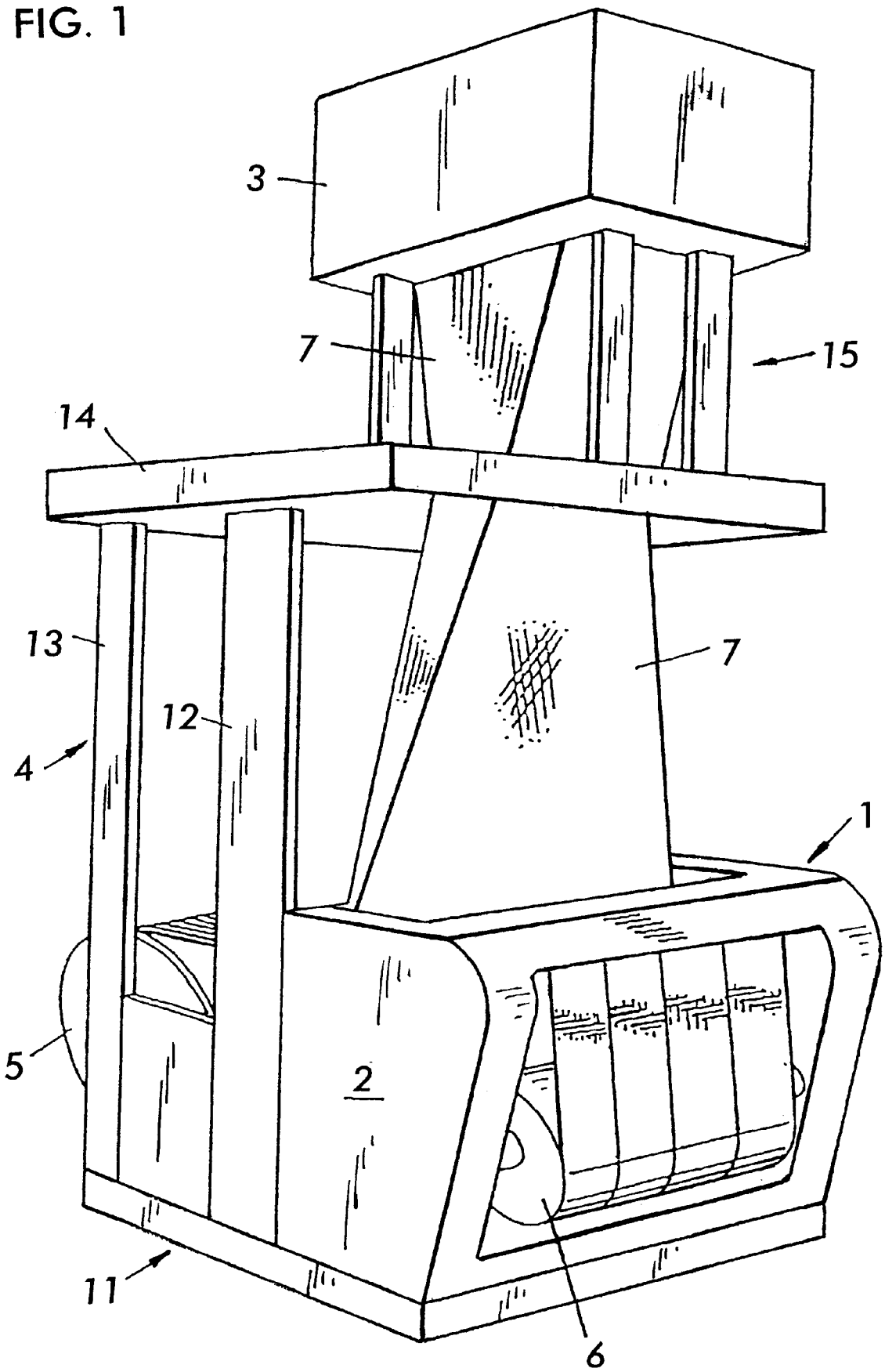
FIG. 1 shows a version of a Jacquard weaving machine for which the arrangement according to the invention is provided.

FIG. 1 shows a three-dimensional illustration of a Jacquard weaving machine illustrated diagrammatically. Weaving machines of this type comprise essentially a weaving machine 1 with a machine stand 2 and with a main drive, not illustrated, reed and warp stop motions, a Jacquard machine 3 disposed above the weaving machine and a stand 4 for the Jacquard machine. When the weaving machine 1 is occupied by an article, said weaving machine also contains a warp beam 5, a cloth beam 6, a harness 7 for forming the shed and at least one stock reel, not illustrated, for a weft thread. In this weaving machine, the weaving region comprises principally the shed to be formed and the beating-up point. Weaving machines of this type may be provided, furthermore, with a thermosetting means and a thermocutting means, as well as a light source.

The stand 4 comprises a basic frame 11, on which the weaving machine 1 is fastened, two columns 12 which are mounted on the basic frame in the region downstream of a weaving machine, two supports 13 which are mounted in the end region of the basic frame, a frame 14 which is mounted on the columns on the supports and extends over the weaving machine 1, and a carrying structure 15 for the Jacquard machine 3, said structure being mounted on the frame 14. The frame 14 may also be designed as a platform, so that the Jacquard machine is accessible for the purpose of inspection and checking. Also provided for these purposes are a ladder or flight of stairs and railings which are omitted in the Figures for the sake of clear illustration.

Reference is made to FIGS. 2 to 6. The arrangement comprises a first and a second subassembly 21 and 22 which are disposed one above the other and extend as far as the underside of the Jacquard machine 3. The first subassembly 21 is assigned to the weaving machine 1 and the second subassembly 22 is assigned to the weaving region and to the harness 7.

Figure 2:
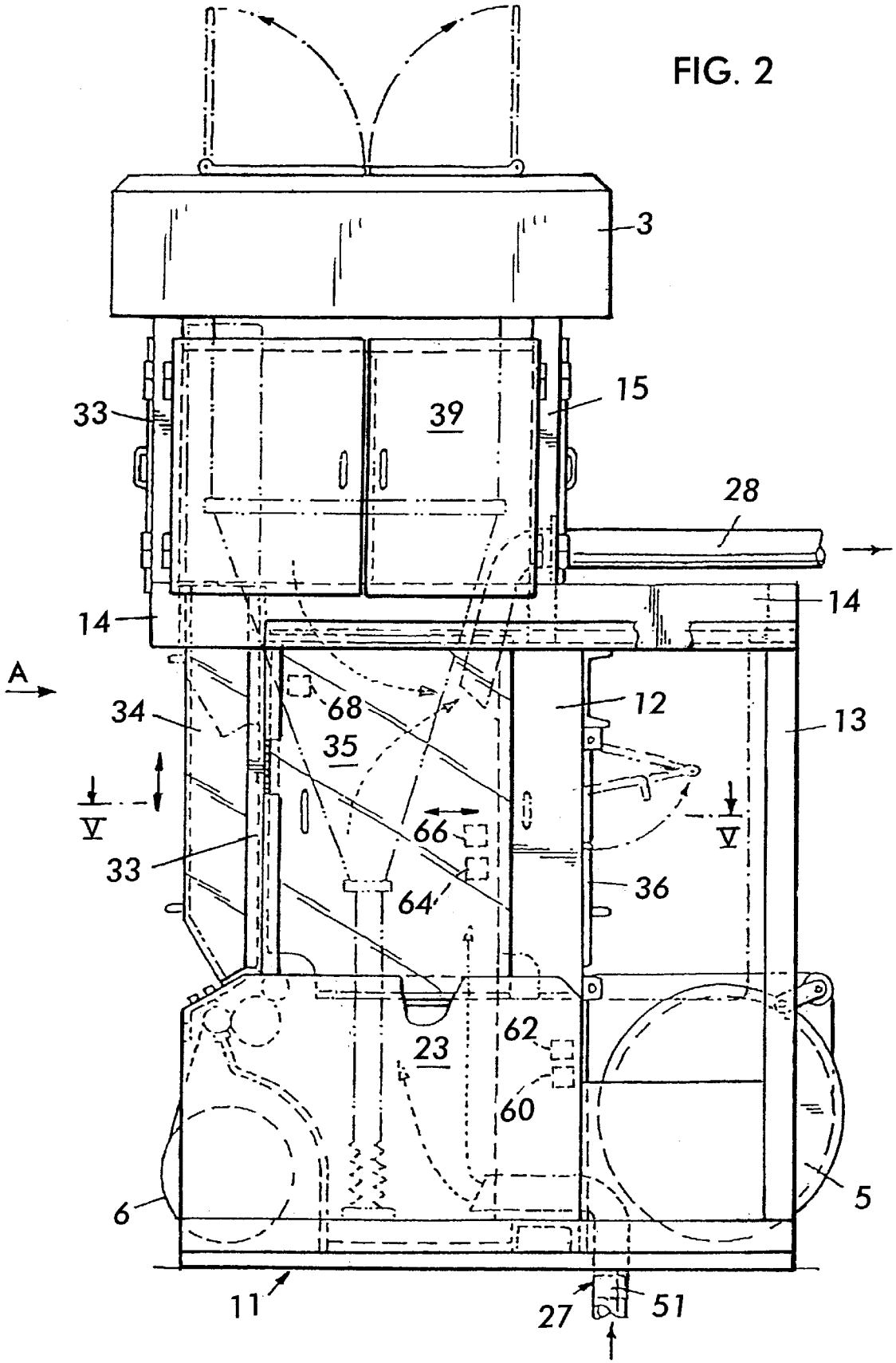
FIG. 2 shows a side view of the Jacquard machine with a version of a Jacquard weaving machine according to the invention.
Figure 3:
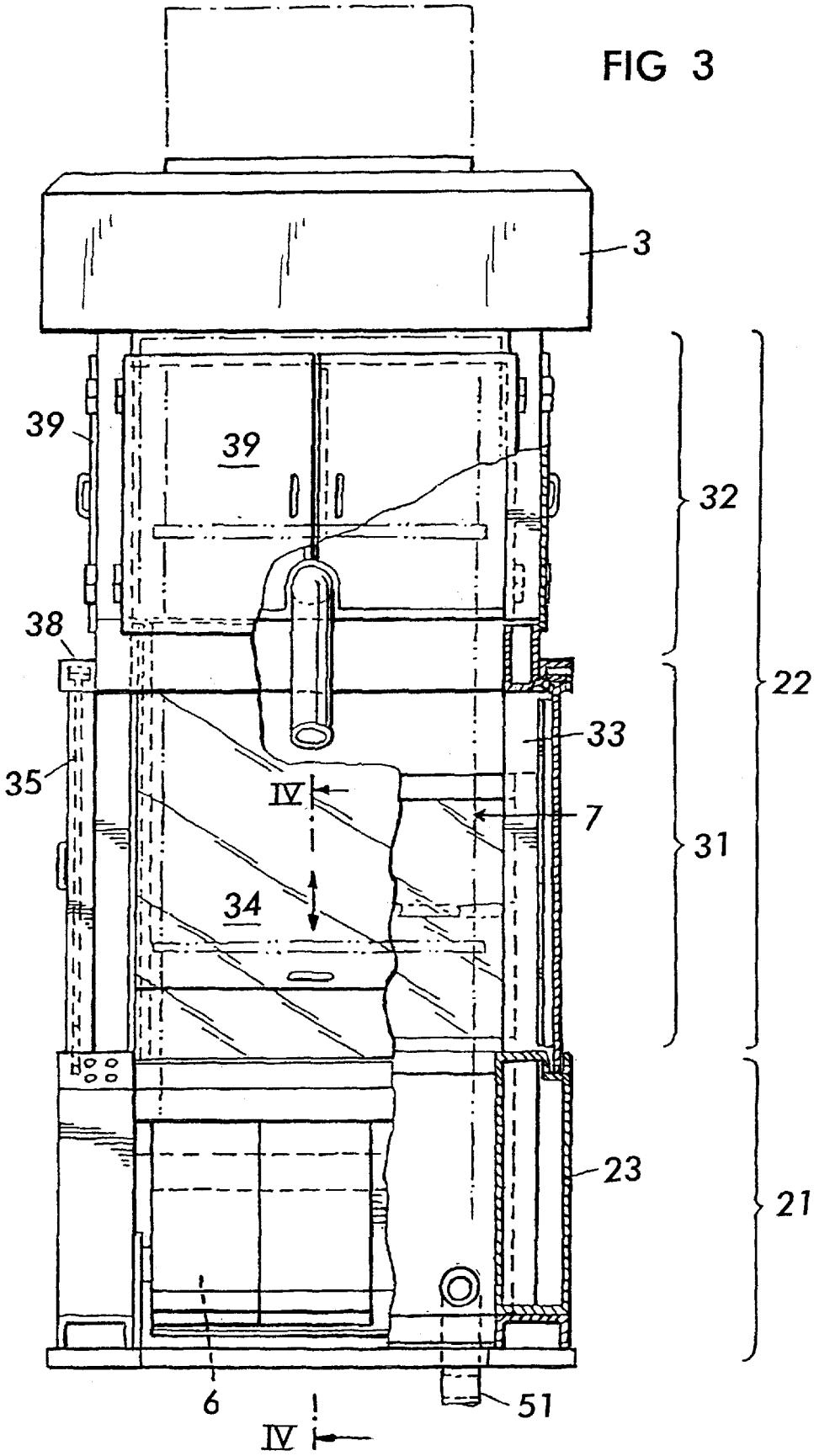
FIG. 3 shows a view in the direction of the arrow A in FIG. 2.

The first subassembly 21 is disposed on the machine stand 2 on the weaving machine 1 and comprises two side walls 23, a front wall 24 and a rear wall 25 which are connected to the machine stand in such a way that the sound sources located within the machine stand, such as the main motor and the drive for the reed (not illustrated) and the cloth take-off 26 are encased (FIG. 4). The pipeline 27 for feeding conditioned air into the space encased by the first subassembly 21, said pipeline containing means 51 for humidifying the air, and a pipeline 28 for the suction extraction of spent air are provided (FIG. 2).

The second subassembly 22 is subdivided into tow subgroups 31, 32. The first subgroup 31 is supported on the machine stand 2 and is connected to the stand 4 of the Jacquard machine 3. The first subgroup 31 comprises two auxiliary supports 33 and four covers 34 to 36 which encase the weaving region and at least a portion of the harness 7. The auxiliary supports 33 are supported at the sides of the weaving machine 1 on the machine stand 2 and are connected to the latter and to the frame 14 of the stand 4 of the Jacquard machine 3. The cover 34 is disposed on the weaver's side and is designed as a sliding door which can be moved in the direction of the Jacquard machine, so that the weaving region is accessible to the weaver. The sliding door 34 is guided in guide battens 37. The covers 35 are disposed at the sides of the weaving machine and are likewise designed as sliding doors which are displaceable back and forth, so that the weaving region is accessible to the weaver from both sides. The sliding doors 35 are guided in guide battens 38. The cover 36 is disposed on the warp side of the weaving machine and is designed as a folding door, so that the weaving region is accessible to the weaver from the warp side. The folding door 36 is mounted on the stand 4 of the Jacquard machine. The doors 34 to 36 consist of a material which is transparent or opaque or of a combination of such materials. The doors may be actuated manually or by means of an electric or pneumatic door drive, e.g. an electric drive gear engagable with a door mounted rack for this purpose being depicted schematically at 72 in FIG. 2. The second subgroup 32 is mounted on the carrying structure 15 for the Jacquard machine. The second subgroup 32 comprises four covers 39 which are designed as double doors and are each secured to the carrying structure 15. Seals, for example, rubber strips, are provided, which are produced according to the design of the covers. As shown in FIG. 6, brush strips 40, which are likewise disposed at the inlet of the warp threads and weft threads, are used for sealing off rotating machine parts.

Figure 7:
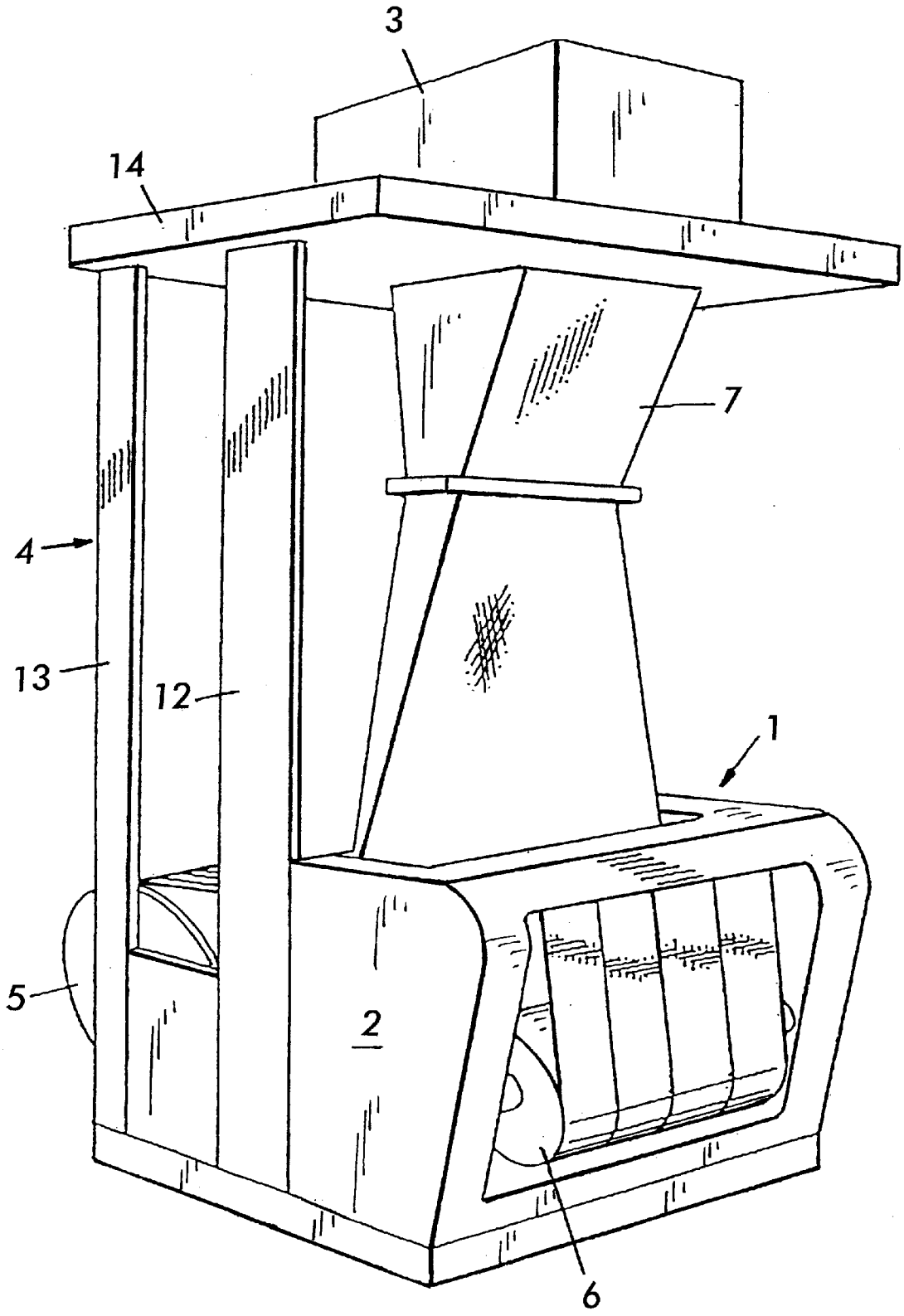
FIG. 7 shows another version of a Jacquard weaving machine for which the arrangement according to the invention is provided.

FIG. 7 shows a Jacquard weaving machine which differs from that according to FIG. 1 in the design of the stand for the Jacquard machine. The stand has the same basic construction and is therefore not described in detail.

Figure 8:
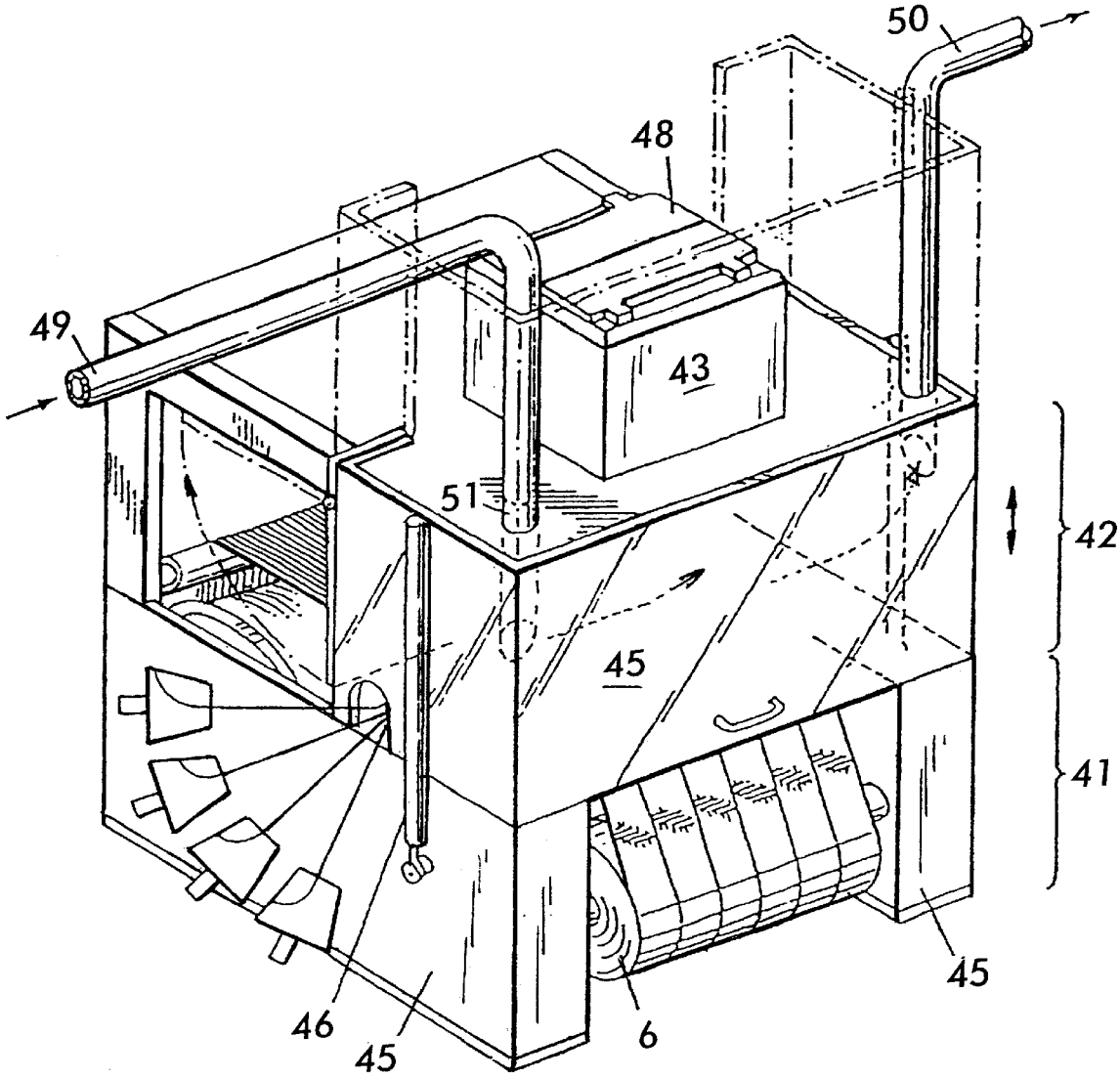
FIG. 8 shows a three-dimensional illustration of a Jacquard weaving machine according to FIG. 6 with an arrangement according to the invention.

The arrangement shown in FIG. 8 comprises three subassemblies 41 to 53 which are arranged one above the other. The first subassembly 41 is disposed at the sides of the machine stand of the weaving machine and encases the machine stand in such a way that the warp beam 5 and the cloth beam 6 are partially exposed. The first subassembly 41 comprises two covers 45 which are mounted on the machine stand. The covers may be of one-part or multi-part design and they consist of metal. Arranged above a first subassembly 41 is a second subassembly 42 which encases the weaving region and the harness 7 and extends as far as the underside of the Jacquard machine 3. The second subassembly 42, comprises a cover 45 movable up and down and a fixed weaving region and the harness 7. These covers may consist of transparent or opaque material. Two linear drives 46 are provided for displacing the moveable cover 45. Above the second subassembly 42 is disposed a third subassembly 43 which surrounds the Jacquard machine 3. The third subassembly 43 is designed as a housing open on one side, with two flaps 48 on the top side. The arrangement has a pipeline 49 for feeding fresh air (either temperature controlled or temperature uncontrolled) or conditioned air, said pipeline containing means 51 for humidifying the air and a pipeline 50 for the suction extraction of the spent air.

A thermosetting device 60 can be carried in the first subassembly casing, and/or a thermosetting device 64 can be carried in the second subassembly casing. In like manner, a thermosetting device 62 can be carried in the first subassembly casing, and/or a thermosetting device 66 can be carried in the second subassembly casing. Also, a light source 68 can be carried in the second subassembly casing.

By means of this arrangement, the environmental pollution due to noise and dust or process vapours in a weaving shed is reduced and the comfort of working on the weaving machine is considerably improved. Furthermore, the risk of accidents is markedly reduced.

What is claimed is:

1. An arrangement for noise reduction, air-conditioning and accident prevention for a Jacquard weaving machine, comprising a plurality of subassemblies mountable on the Jacquard weaving machine to encase said Jacquard weaving machine, the subassemblies including a first subassembly defining a first casing enclosing to the weaving machine, said first subassembly including means for introducing one of conditioned air and fresh air to a space encased by said first subassembly, and a second subassembly defining a second casing enclosing a weaving region and a weaving machine harness, said second subassembly including means for extracting air by suction from a space encased by said second subassembly.

2. An arrangement according to claim 1, wherein the second subassembly is disposed above the first subassembly and extends to an underside of the Jacquard machine.

3. An arrangement according to claim 1, further comprising a third subassembly encasing the Jacquard machine.

4. An arrangement according to claim 3, wherein each subassembly includes a plurality of covers.

5. An arrangement according to claim 4, wherein said plurality of covers includes at least one of a flap, a folding door, and a sliding door.

6. An arrangement according to claim 4, wherein the covers are at least one of a transparent material and an opaque material.

7. An arrangement according to claim 4, further comprising sealing means associated with said covers for sealing off the spaces enclosed by said subassemblies relative to Jacquard machine surroundings.

8. An arrangement according to claim 4, wherein at least some of said covers are moveable between at least two cover positions.

9. An arrangement according to claim 8, wherein said covers are moveable manually between said cover positions.

10. An arrangement according to claim 8, further comprising means for automatically moving said covers between said cover positions.

11. An arrangement according to claim 1, wherein said air introducing means comprises a pipeline.

12. An arrangement according to claim 11, further comprising humidifying means disposed in said pipeline directly in front of the first casing for humidifying air introduced into said first casing.

13. An arrangement according to claim 11, wherein said fresh air is one of thermally controlled and thermally uncontrolled fresh air.

14. An arrangement according to claim 1, wherein said air extracting means comprises a suction pipe line connected to said second casing.

15. A Jacquard weaving machine, comprising:

one of a gripper weaving machine and a jet-weaving machine;

a Jacquard machine;

a stand for said Jacquard machine;

a weaving machine stand;

a first subassembly defining a casing enclosing the weaving machine, said first subassembly including means for introducing one of conditioned air and fresh air to a space encased by said first subassembly, said first subassembly being mounted on said weaving machine stand; and a second subassembly defining a casing enclosing a weaving region and a weaving machine harness, said second subassembly including means for extracting air by suction from a space encased by said second subassembly, said second subassembly being mounted on the Jacquard machine stand.

16. A Jacquard weaving machine according to claim 4, further comprising a thermocutting device carried in at least one of the first casing and the second casing.

17. A Jacquard weaving machine according to claim 4, further comprising a thermosetting device carried in at least one of the first casing and the second casing.

18. A Jacquard weaving machine according to claim 4, further comprising a light source carried in the second casing.

* * * * *

UNITED STATES PATENT AND TRADEMARK OFFICE

CERTIFICATE OF CORRECTION

PATENT NO. : 6,604,553 B1
DATED : August 12, 2003
INVENTOR(S) : Francisco Speich It is certified that error appears in the above-identified patent and that said Letters Patent is hereby corrected as shown below:

Title page,
Item [22], PCT Filed, date should read -- Nov. 23, 1999 --.

Signed and Sealed this

Twenty-third Day of December, 2003

JAMES E. ROGAN
*Director of the United States Patent and Trademark Office*